United States Patent [19]

Geiger et al.

[11] Patent Number: 4,616,617

[45] Date of Patent: Oct. 14, 1986

[54] METHOD AND ARRANGEMENT FOR COMBUSTION CHAMBER IDENTIFICATION IN AN INTERNAL COMBUSTION ENGINE

[75] Inventors: Istvan Geiger, Brunswick; Uwe Waschatz, Meine, both of Fed. Rep. of Germany

[73] Assignee: Volkswagenwerk Aktiengesellschaft, Wolfsburg, Fed. Rep. of Germany

[21] Appl. No.: 720,543

[22] Filed: Apr. 8, 1985

[30] Foreign Application Priority Data

Apr. 7, 1984 [DE] Fed. Rep. of Germany ..... 3413271

[51] Int. Cl.[4] ..... F02M 39/00

[52] U.S. Cl. ..... 123/436; 123/419; 123/357

[58] Field of Search ..... 123/436, 419, 357, 358, 123/359; 73/119 A

[56] References Cited

U.S. PATENT DOCUMENTS

| | | | |
|---|---|---|---|
| 4,153,013 | 5/1979 | Bianchi | 123/436 |
| 4,357,662 | 11/1982 | Schira | 123/436 |
| 4,375,668 | 3/1983 | Leung | 123/419 |
| 4,448,162 | 5/1984 | Ninomiya | 123/419 |
| 4,448,171 | 5/1984 | Ninomiya | 123/419 |
| 4,450,817 | 5/1984 | Ibuki | 123/436 |
| 4,476,833 | 10/1984 | Johnson | 123/419 |
| 4,483,295 | 11/1984 | Iida | 123/419 |
| 4,495,920 | 1/1985 | Matsumura | 123/436 |
| 4,535,406 | 8/1985 | Johnson | 123/436 |
| 4,539,956 | 9/1985 | Hengel | 123/436 |

*Primary Examiner*—Carl Stuart Miller

*Attorney, Agent, or Firm*—Brumbaugh, Graves, Donohue & Raymond

[57] ABSTRACT

For the purpose of identification of a combustion chamber producing undesirable hunting in a fuel injection combustion engine, the duration of injection of a defined injection valve is changed in such a manner that additional hunting is caused, and from the crank angle interval (KW) between the additional and the undesirable hunting, is derived, taking into account the rotational speed n of the engine, an identification signal for the combustion chamber to be identified. The identification signal is utilized to change the fuel injection time for the combustion chamber causing the uneveness to eliminate the latter.

7 Claims, 5 Drawing Figures

METHOD AND ARRANGEMENT FOR COMBUSTION CHAMBER IDENTIFICATION IN AN INTERNAL COMBUSTION ENGINE

BACKGROUND OF THE INVENTION

The invention relates to internal combustion engines of the type in which fuel is injected into the combustion chambers by electronically controlled injection valves associated with the respective chambers. More specifically, it relates to a method and apparatus in which combustion chamber identification in an internal combustion engine of this general character is accomplished in a simple and highly efficient and effective manner.

In fuel-injection combustion engines, it may become difficult for various reasons to obtain without any additional sensors, e.g., on the camshaft of the engine, signals for associating the individual combustion chambers and, respectively, the torque shares generated by them, on the one hand, and the injection valves therefor on the other hand. In the case of injection valves actuated at different times, these difficulties are due to the fact that a working cycle of four-stroke engines extends over two rotations of the crankshaft. In a 4-cylinder 4-stroke Otto engine, for example, with the ignition sequence 1-3-4-2, two cylinders, namely 1 and 4, or 2 and 3, would always attain upper dead center simultaneously, but the inlet valve of only one of the two cylinders in TDC-state is opened, i.e. the cylinder is sucking in. This cylinder must be known in order to synchronize the electronic fuel injection to deliver fuel into the intake port of this cylinder only. In the case of other known fuel-injection engines, there occurs simultaneously a fuel advance feed into the intake ports of all combustion chambers, so that here, again, the state of the art requires additional camshaft sensors for obtaining such association signals.

The necessity of combustion chamber identification also arises if undesirable hunting, i.e. an unevenness in engine speed, resulting from differences in engine torques created in the individual cylinders, occurs. In order to alter an engine parameter only for the cylinder causing said hunting in a manner to eliminate the unevenness it is necessary to know this cylinder.

It is an object of the invention to provide a method and apparatus for combustion chamber identification in an internal combustion engine without the use of additional sensors, e.g, on the camshaft of the engine.

SUMMARY OF THE INVENTION

In the first case referred to above according to the invention a combustion chamber is identified by altering the duration of fuel injection of a selected injection valve so that additional hunting in the engine speed occurs, determining the interval in time or crank angle between the additional hunting and an edge of the associated injection pulse, and deriving from the interval an identification signal indicating the combustion chamber having a certain mode of operation. In a 4-cylinder 4-stroke engine, if the interval in crank angle is 450, the injection takes place in the right moment. If, on the other hand, the interval is almost 810 (one crankshaft rotation later), the inlet valve at the moment of fuel injection was closed.

Further within the scope of the invention, a preferred purpose is seen within the framework of control, with a view to a largely equal torque delivery to the engine crankshaft, of all combustion chambers, towards which end, if necessary, operation parameters at individual combustion chambers causing undesirable hunting must be modified.

According to the invention, a combustion chamber causing undesirable roughness in the engine speed is identified by sensing the rotational speed of the engine, detecting any unevenness in the sensed engine speed by a conventional unevenness sensor, altering the duration of fuel injection of a selected injection valve in response to any detected unevenness to a degree to cause additional hunting or unevenness in the engine speed, determining from the pertinent mean rotational speed of the engine, the interval in time or crank angle between the additional hunting and an edge of the associated injection pulse and, respectively, the undesirable hunting, and deriving from the determined time interval an identification signal indicating the combustion chamber causing the undesirable hunting.

In a preferred embodiment, the identification signal serves to actuate means for effecting combustion chamber selection correction of at least one parameter influencing the output of the combustion chamber causing the undesirable hunting.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

For purpose of illustration only, the invention will be described below as applied to the operation of a fuel injection internal combustion engine with computer controlled fuel injection, and having fuel injection valves 16, 18, 20 and 22 for injecting fuel from a fuel line 24 into the respective engine combustion chambers.

Figure 1:
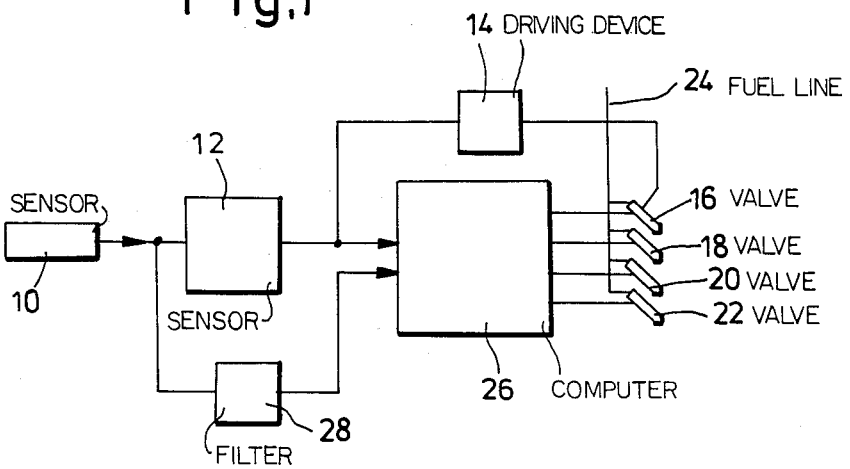
FIG. 1 is a schematic circuit diagram of a combustion chamber identification and fuel injection system constructed according to the invention.
Figure 3:
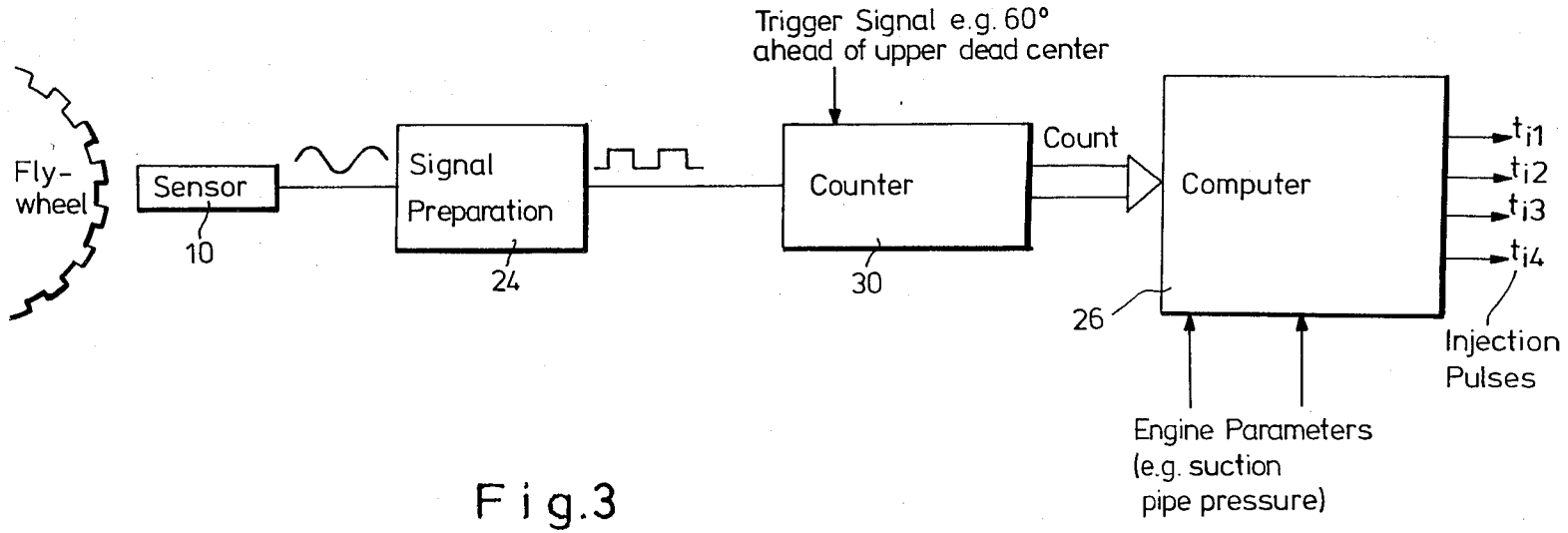
FIG. 3 is a block diagram illustrating part of the system shown in FIG. 1 in greater detail.

Referring now to FIGS. 1 and 3, a conventional rotational speed sensor 10 for sensing the rotational speed of the engine delivers speed signals to an unevenness sensor 12 capable of detecting rotational speed fluctuations caused by the manner of operation of individual combustion chambers. Such sensors are well known in the art and need not be described in detail herein.

Figure 2:
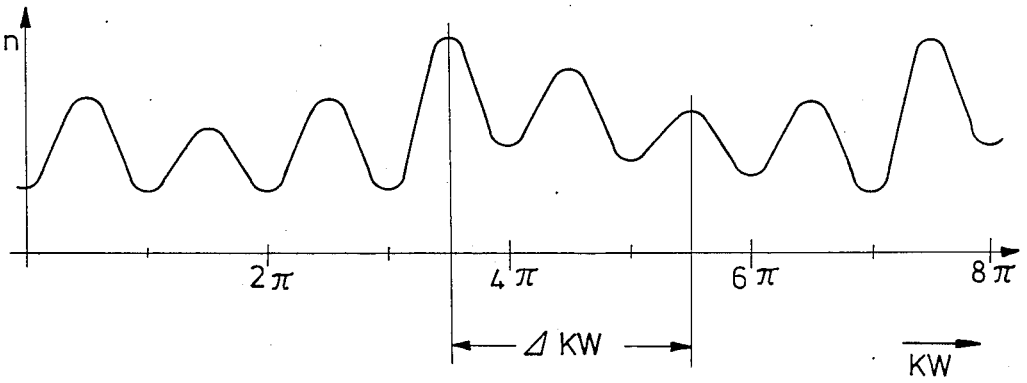
FIG. 2 is a typical engine rotational speed curve plotted against a crank angle for an engine utilizing the control system of FIG. 1.

During normal operation of the combusion engine, the rotational speed signal from the sensor has a periodic characteristic in that the individual combustion chambers deliver, as it were, speed shares through the partial outputs generated by them. FIG. 2 shows a typical curve of the rotational speed n plotted against the crank angle KW.

It will be assumed by way of example that one of the combustion chambers (in FIG. 2 the combustion chamber delivering the second rotational speed share) has a smaller output than desired so that the maximum of the rotational speed curve for this chamber is lower than for the rotational speed shares of the other combustion chambers.

This undesirable unevenness in engine speed is detected by the unevenness sensor 12 which delivers an output signal directly to the driving device 14 only for a selected one of the fuel injection valves for the combustion chambers, e.g., injection valve 16. This injection valve has been chosen to represent a reference point, which, as will be shown below, will assist a computer 26 to identify the chamber causing the unevenness. The signal thus supplied to the valve control driving device 14, which may be part of computer means 26, generates a lengthening of the injection duration of the injection valve 16 causing the combustion chamber corresponding thereto to increase its contribution to the rotational speed of the crankshaft. This results in a characteristic peak at, say, the 7/2 crankshaft position on the speed curve of FIG. 2.

The uneveness sensor 12 also delivers a signal indicating the undesirable unevenness to the computer 26, which may be an injection computer already present within the vehicle, and which from the interval, designated in FIG. 2 by KW, between the additional unevenness and the undesirable unevenness, obtains a signal identifying the combustion chamber which is the cause of the undesirable unevenness. In order to take into account the pertinent mean rotational speed during the operating cycle of the engine dealt with, there is delivered to the computer 26 via a filter 28 a signal representing the mean value of the rotational speed n. The computer processes both signals to provide an extended drive signal only for the injection valve 20 for the combustion chamber causing the unevenness, whereby the undesired hunting is counteracted.

Figure 4:
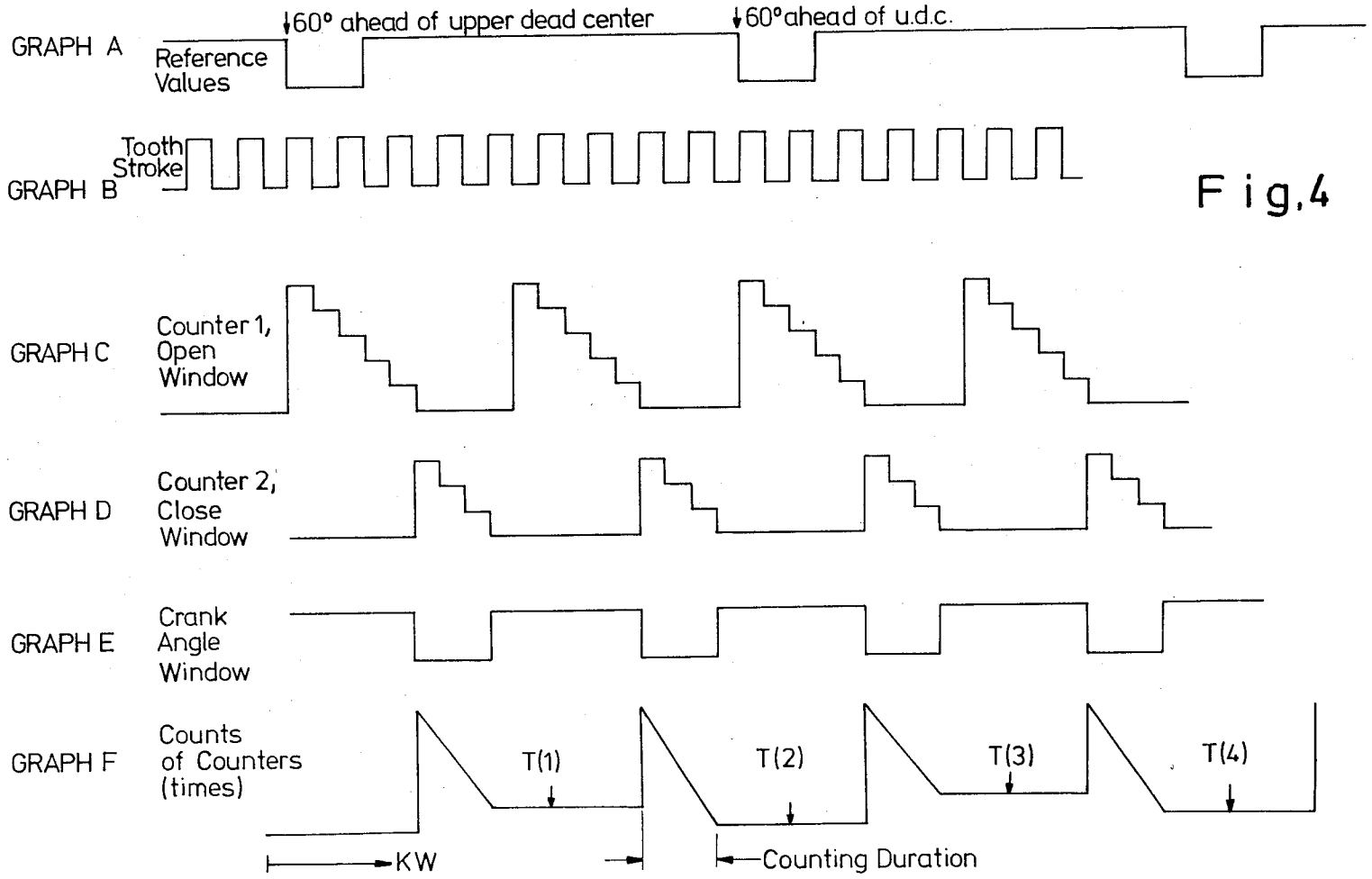
FIG. 4 is a graph illustrating typical timing diagrams for the system shown in FIG. 1.

More specifically, in operation of the apparatus of FIGS. 1 and 3, the output of the rotational speed sensor 10, which is preferably an inductive device associated with the engine flywheel, is fed to a signal shaper 24 which delivers to a counter 30 a pulse for each flywheel tooth (Graph B of FIG. 4). Reference marks, e.g., likewise on the flywheel, generate reference signals, at, say, 60° ahead of upper dead center (Graph A of FIG. 4) which are also fed to the counter 30. By means of these signals crankshaft angle windows are set (Graph E of FIG. 4) which are located within the range of 90° ahead of and after top dead center. The window width may be, e.g., 10 teeth. Both the start and the end (i.e., the duration) of the windows are determined by counters which are actuated by tooth pulses (Graphs C and D of FIG. 4). The speed-dependent time required by the windows in order to pass the sensor is determined as pulse number by counting down or up by a counter during this time interval (Graph F of FIG. 4). In the case of four cylinders, four windows correspond to one working cycle of the engine. The counter conditions T(1) to T(4) for each window (Graph F of FIG. 4) which thus correspond to the opening times of the windows are read into the computer means 26.

Figure 5:
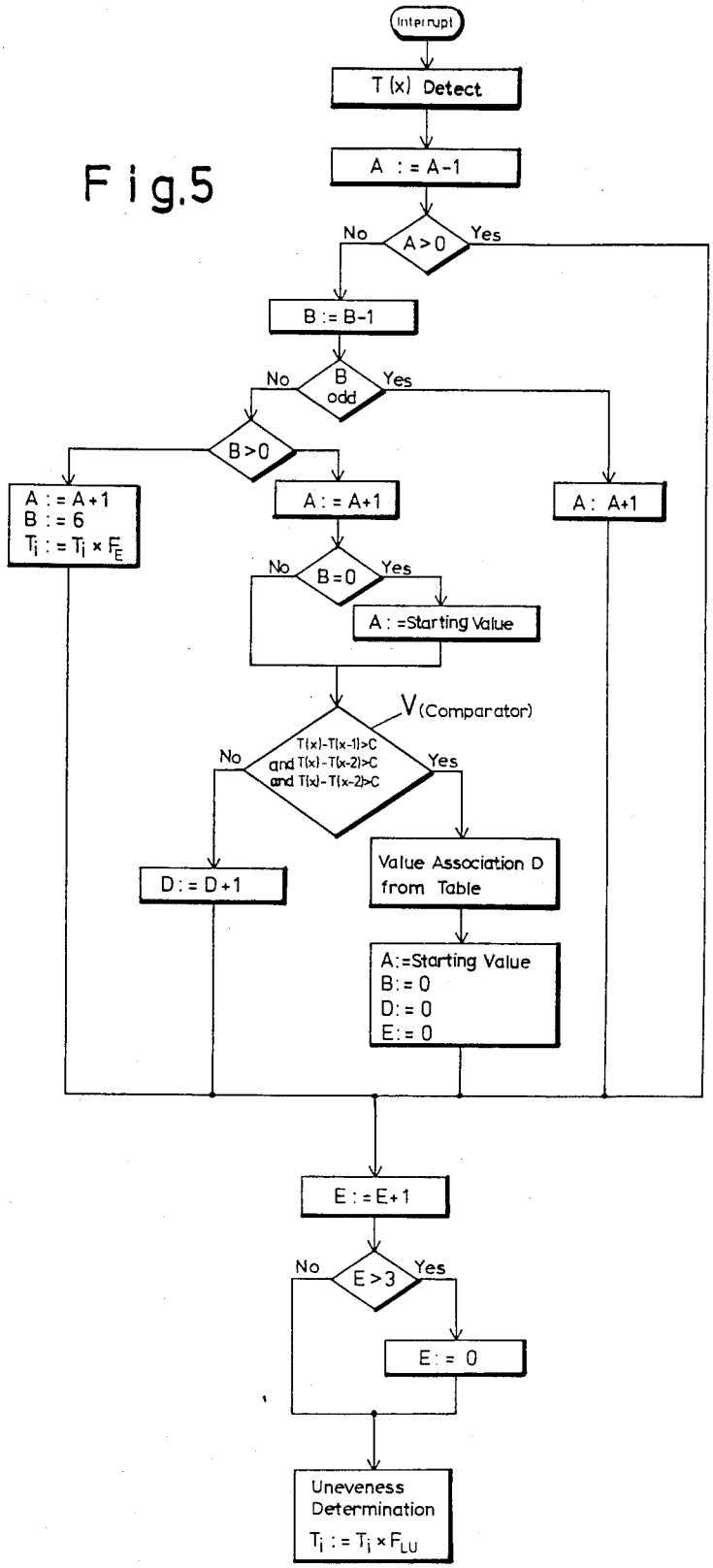
FIG. 5 is a flow chart illustrating a typical computer program utilized in the system shown in FIG. 1.

The manner of operation of the computer 26 can best be described by reference to the flow diagram in FIG. 5, wherein T(x) signifies T(1) . . . T(4) and a counter A defines the number of ignitions in accordance with which cylinder identification occurs cyclically. A counter B activates successive units in the computer only during those operating phases of the engine in which cylinder identification can occur. A counter D determines the number of injection pulses between additional hunting and the associated injection pulse and thereby the association of the injection valves with the cylinders that reach dead center simultaneously. In the flow diagram, A, B and D also signify the counts of corresponding counters. $F_E$ is the factor by which the injection time for valve 16, taken from the stored performance characteristics, is modified to produce the additional hunting.

In operation, first a comparator V (FIG. 5) determines for a plurality of preceding windows —x1—, —x2, etc., whether their opening times deviate from the opening time of the currently present window by more or less than a predefined value C. Only when all preceding window times exceed or are below C is the currently present window the one corresponding to the additional hunting. In such a case, there can be taken from a stored table the actuation sequence of the injection valves and, taking into consideration the count of the counter D, it can be related to the crank angle interval between the additional hunting and the associated injection pulse, i.e., the location of the additional hunting. By means of a synchronized counter E, which rotates and has four stages (corresponding to the number of cylinders and windows), each window is interrogated as to whether the undesirable hunting occurs. In the affirmative, a signal is generated which changes the associated injection time taken from the performance characteristics by a factor $F_{LU}$ which removes the uneveness.

It will be understood that the invention may be used advantageously for combustion diagnostics, and for controlling the filling of individual combustion chambers by influencing individual throttle valves. Also, it is to be noted that combustion chamber identification according to the invention can be activated and effected at predefined moments in time, can be repeated at equal time intervals, can occur after each starting process, or can occur on changes in the output of a combustion chamber.

Having set forth the general nature and specific embodiments of the present invention, its scope is now particularly pointed out in the appended claims.

We claim:

1. A method for combustion chamber identification in an internal combustion engine having a plurality of combustion chambers and a plurality of injection valves individually related to said combustion chambers, comprising the steps of:

sensing the rotational speed of the engine;

detecting any unevenness or hunting in the sensed engine speed;

altering the duration of fuel injection of a selected injection valve in response to any detected unevenness by an amount sufficient to cause additional hunting in the engine speed;

determining the interval in time or crank angle between the additional hunting and the unevenness; and deriving, from the determined interval, an identification signal indicating the combustion chamber causing the unevenness.

2. The method according to claim 1, further comprising the step of:

utilizing said identification signal to effect combustion chamber correction of at least one parameter influencing the output of the combustion chamber causing the unevenness.

3. The method according to claim 2, wherein the parameter influencing the output of the combustion chamber causing the unevenness is the duration of injection of fuel into the combustion chamber.

4. In an internal fuel injection combustion engine having a plurality of combustion chambers and a plurality of fuel injection valves individually related to said combustion chambers, a combustion chamber identification system, comprising:

a rotational speed sensor for sensing the rotational speed of the engine;

means for detecting any unevenness or hunting in the sensed engine speed;

a driving device to alter the duration of fuel injection of a selected injetion valve in response to any detected unevenness to a degree to cause additional hunting in the engine speed;

means jointly responsive to the sensed rotational speed and detected unevenness in the engine, for determining the interval in time or crank angle between the additional hunting and the unevenness; and means for deriving, for the determined time interval, an identification signal indicating the combustion chamber causing the unevenness.

5. The identification system of claim 4, further comprising;

means for utilizing said identification signal to effect combustion chamber correction of at least one parameter influencing the output of the combustion chamber causing the unevenness.

6. The identification system of claim 5, wherein the parameter influencing the output of the combustion chamber causing the unevenness is the duration of injection of fuel into the combustion chamber.

7. A method for identifying a combustion chamber having a certain mode of operation in a internal combustion engine having a plurality of combustion chambers and a plurality of fuel injection valves individually related to the combustion chambers and actuated in response to injection pulses, comprising the steps of:

altering the duration of fuel injection of a selected injection valve to a degree to cause additional hunting in the engine speed;

determining the interval in time or crank angle between the additional hunting and an edge of the associated injection pulse; and deriving from the determined interval, an identification signal indicating the combustion chamber having a certain mode of operation.

* * * * *